US010256549B2

(12) United States Patent
Sharawi et al.

(10) Patent No.: US 10,256,549 B2
(45) Date of Patent: Apr. 9, 2019

(54) COMPACT SIZE, LOW PROFILE, DUAL WIDEBAND, QUASI-YAGI, MULTIPLE-INPUT MULTIPLE-OUTPUT ANTENNA SYSTEM

(71) Applicant: King Fahd University of Petroleum and Minerals, Dhahran (SA)

(72) Inventors: Mohammad S Sharawi, Dhahran (SA); Syed S Jehangir, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 15/477,306

(22) Filed: Apr. 3, 2017

(65) Prior Publication Data

US 2018/0287244 A1 Oct. 4, 2018

(51) Int. Cl.
*H01Q 13/10* (2006.01)
*H01Q 1/48* (2006.01)
(Continued)

(52) U.S. Cl.
CPC ..... *H01Q 13/106* (2013.01); *H01Q 1/36* (2013.01); *H01Q 1/38* (2013.01); *H01Q 1/48* (2013.01);
(Continued)

(58) Field of Classification Search
CPC ..... H01Q 1/243; H01Q 13/106; H01Q 15/14; H01Q 1/38; H01Q 1/48
(Continued)

(56) References Cited

U.S. PATENT DOCUMENTS 6,483,476 B2 * 11/2002 Cox ..... H01Q 9/265 343/815
7,015,860 B2 * 3/2006 Alsliety ..... H01Q 1/38 343/700 MS
(Continued)

FOREIGN PATENT DOCUMENTS

CA 204333258 U 5/2015
KR 101345764 B1 1/2014
(Continued)

OTHER PUBLICATIONS

Du, Z. et al., "Compact Quasi-Yagi Antenna for Handheld UHF RFID Reader," ACES Journal, vol. 30, No. 8, Aug. 2015, pp. 860-865.

*Primary Examiner* — Brian K Young
(74) *Attorney, Agent, or Firm* — Hauptman Ham, LLP

(57) ABSTRACT

A compact, low profile, Yagi-based MIMO antenna for small form factor devices including mobile phones and other compact wireless devices. The antenna has a dielectric substrate and an electrically conductive ground plane that acts as a reflector. A driven element and director are on the substrate. In one embodiment, the driven element is an arcuate semi-loop connected to meandered legs and the director element is arcuate, both printed on the substrate. In another embodiment, the driven element is a semi-loop and the director is rectangular, both etched from the ground plane. In both embodiments, a transmission line conveys RF power to the antenna to excite the driven element. Two of the antennas can be mounted side-by-side on a substrate to form a dual-antenna system, and two of the antenna systems can be placed in a tablet or the like.

18 Claims, 13 Drawing Sheets
(13 of 13 Drawing Sheet(s) Filed in Color)

(51) Int. Cl.

| | |
|---|---|
| ***H01Q 1/36*** | (2006.01) |
| ***H01Q 1/38*** | (2006.01) |
| ***H01Q 15/14*** | (2006.01) |
| ***H01Q 7/00*** | (2006.01) |
| ***H01Q 19/30*** | (2006.01) |
| ***H01Q 21/28*** | (2006.01) |
| *H01Q 1/24* | (2006.01) |

(52) U.S. Cl.
CPC ..... *H01Q 7/00* (2013.01); *H01Q 15/14* (2013.01); *H01Q 19/30* (2013.01); *H01Q 21/28* (2013.01)

(58) Field of Classification Search
USPC ..... 343/702
See application file for complete search history.

(56) References Cited

U.S. PATENT DOCUMENTS

| | | | | |
|---|---|---|---|---|
| 8,228,254 | B2 | 7/2012 | Foltz et al. | |
| 8,384,600 | B2 | 2/2013 | Huang et al. | |
| 8,497,811 | B2 | 7/2013 | Huang | |
| 8,558,748 | B2 * | 10/2013 | Chen | H01Q 19/30 343/792.5 |
| 8,912,973 | B2 | 12/2014 | Werner et al. | |
| 9,054,423 | B2 | 6/2015 | Dandekar et al. | |
| 9,373,893 | B2 * | 6/2016 | Stutrud | G06K 7/10346 |
| 9,515,377 | B2 | 12/2016 | Zhang et al. | |
| 9,531,084 | B2 | 12/2016 | Li et al. | |
| 2009/0174557 | A1 | 7/2009 | Nikitin et al. | |
| 2009/0295667 | A1 | 12/2009 | Ma et al. | |
| 2015/0035714 | A1 | 2/2015 | Zhou | |
| 2015/0194736 | A1 | 7/2015 | Diukman et al. | |
| 2016/0006116 | A1 | 1/2016 | Sharawi et al. | |
| 2016/0294052 | A1 | 10/2016 | Baek et al. | |

FOREIGN PATENT DOCUMENTS

| | | | |
|---|---|---|---|
| KR | 101630674 | B1 | 6/2016 |
| KR | 20160093516 | A | 8/2016 |

* cited by examiner

COMPACT SIZE, LOW PROFILE, DUAL WIDEBAND, QUASI-YAGI, MULTIPLE-INPUT MULTIPLE-OUTPUT ANTENNA SYSTEM

FIELD OF THE INVENTION

This invention relates generally to the field of wireless communication systems. More particularly, it relates to compact antennas in multi-input multi-output (MIMO) configurations for small form factor devices including mobile phones and other compact wireless devices. The antenna system of the invention has wide bandwidth, high directivity and high efficiency and satisfies both fourth generation (4G) and 5G wireless communication bands with wide bandwidth.

BACKGROUND OF THE INVENTION

There is increasing interest in developing wideband and/or multiband antenna systems for use in wireless communications, microwave tomography, remote sensing, and other applications. The demand for high channel capacity (high data rate) is rapidly increasing because high data rate is required for multiple functionalities like browsing the internet, video streaming, online gaming, and on-road navigation. The next generation wireless standard will provide an increase in the overall channel capacity 1,000 times greater than current capacity, with multi-Giga bits per second expected to be a reality by the year 2020.

The multiple-input-multiple-output (MIMO) technology will therefore serve as a key enabling factor in achieving such high data rates. These antennas will cover different frequency bands of different standards and will support high data rates. Many portable devices have now multiple functionalities as compared to early generations with the existence of multiple antennas. Depending upon the size and targeted application, the user terminal will be allowed to carry up to 8 antennas with a minimum of 4 antenna elements.

Future wireless standards will rely on novel technologies to increase the data rates and provide reliable links. Current fourth generation (4G) and upcoming 5G will rely on multiple antenna systems with multi-standard support. These multiple standards will operate in different frequency bands with enough frequency bandwidth to provide the expected high data throughput. Antenna elements are usually isolated from one another, and thus occupy a large space within a wireless terminal. The concept of connected arrays (CA) was recently introduced for single band coverage and with single arrays. Cell phones will have elements that are of smaller size and maybe less efficiency than tablets that have more real estate to have more efficiency antenna systems.

The use of multiple-input multiple-output (MIMO) technology as well as the use of higher frequency bands beyond those currently used for wireless communications (i.e. above 6 GHz) will be key factors in achieving the throughput increase. The user terminal will be allowed to carry up to 8-antenna elements within current cellular bands below 6 GHz, with a minimum of 4-antenna elements, depending on the device size and application.

Integrating higher frequency band antennas or antenna arrays along with MIMO antenna systems at the lower bands will be a must to satisfy the large increase in the data throughput expected, as bandwidths of at least 500 MHz are required, and these are not available in the lower spectrum bands.

Such integrated antenna systems that support multiple antennas as well as multiple standards with capabilities both less than 6 GHz and above 10 GHz are of extreme importance for upcoming wireless handheld devices to be able to achieve the expected performance of 5G standards.

Due to the use of multiple antennas in MIMO configurations, space becomes an issue, especially for lower frequency bands, as the antenna elements become larger in size. Coming up with novel compact size and highly efficient antennas is very desirable. At higher frequency bands, i.e. higher than 10 GHz, the free space attenuation of the radio signals becomes large, and thus antenna array configurations are preferred to provide higher gains and compensate for such losses.

Designing a novel, compact size, directional MIMO antenna system with high gain, high isolation and low correlation between the MIMO channels is of great value because they become compatible with multiple standards and simultaneously cover multiple bands without the need of extra hardware for reconfigurability or frequency switching. Directional radiation characteristics, along with wide bandwidth and high efficiency, are required for good MIMO performance, as directional patterns mean more isolated channels and thus better performance and low inter-element correlation. Therefore, there is high interest in using directional antennas like Yagi-Uda in future 5G technology.

Yagi-Uda antennas are well known for their highly directional radiation patterns, high FBR, high gain, low cross polarization, controllable input impedance, and moderate bandwidth that can be increased. Yagi antennas are highly compatible with printed RF circuitry because they are robust and can be easily fabricated. However, the main challenge faced in designing Yagi antennas is their large size due to the presence of the large ground plane or number of reflector elements required to achieve high 1-BR, and the large number of director elements required to achieve high directivity. Hence, such antenna systems are not suitable to be used in small form factor wireless devices due to the limited space available. Despite the distinct features of such antennas, the size issue limits their use in modern small user terminals.

Accordingly, there is need for a highly miniaturized, compact size, low profile, Yagi-based MIMO antenna system for small form factor devices including mobile phones and other compact wireless devices, wherein the antenna system has wide bandwidth, high directivity and high efficiency and satisfies both fourth generation (4G) and 5G wireless communication bands.

SUMMARY OF THE INVENTION

The present invention is a highly miniaturized, compact size, low profile Yagi-based MIMO antenna system. A simple back-lobe reduction technique is proposed for Quasi-Yagi antennas that does not require the complex techniques using electromagnetic band-gap (EBG) structures, isolation surfaces, multiple 3D metallic layers, multiple reflector elements, and resistor and inductor loading, etc. of prior art devices. The antenna of the invention is suitable for either microstrip or slot antennas.

In a first embodiment, the antenna is designed and fabricated on a two-layer printed circuit board. A single antenna in a MIMO configuration can be utilized in current and future small form factor wireless terminals and handheld devices. The invention comprises a semi-loop, meandered Yagi antenna design used as a driven element (the one which is directly excited using a transmission line), and an arcuate ring sector director element used to obtain high directivity and highly directional radiation pattern. The proposed design is a highly miniaturized printed Quasi-Yagi antenna design using a very simple miniaturization technique of semi-loop meandering and small ground plane structure. The Quasi-Yagi antenna system of the invention is highly compact compared to conventional complex non-printed Quasi-Yagi miniaturization techniques that use fractal geometries or metamaterial structures. This embodiment of the invention uses a truncated ground plane reflector element with a size of only 60 mm×19.1 mm, which is very compact compared to other Quasi-Yagi reflector sizes described in literature. The invention not only reduces the back-lobe radiation, but it also switches the beam by 90° from the non-end-fire direction to the desired end-fire direction, which is one of the main requirement for a Yagi-Uda antenna. The antenna can then be used in a MIMO configuration for utilization in current and future small form factor wireless terminals and handheld devices.

In a second embodiment, the invention is a compact size, printed and low profile Yagi-Like antenna that mimics the features of a Yagi antenna. The antenna is etched from the ground plane and is based on a half-arc slot antenna with a complementary functional rectangular slot that acts as a director to increase the front to back ratio of the antenna. The antenna does not have any directors in the conventional sense, and is very compact. It is designed and fabricated on a two-layer printed circuit board. The single antenna is then used in a MIMO configuration that can be utilized in current and future small form factor wireless terminals and handheld devices.

The antenna systems in both embodiments are compact and do not occupy much space in the system ground plane, making them very attractive for handheld and portable wireless terminals. The specific dimensions disclosed hereinafter for the two invention embodiments are optimized for the targeted bands and can vary based on the device under consideration.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The foregoing, as well as other objects and advantages of the invention, will become apparent from the following detailed description when taken in conjunction with the accompanying drawings, wherein like reference characters designate like parts throughout the several views, and wherein:

FIG. 5(*b*) shows the simulated gain and efficiency curves of antenna 32 in the 2-element MIMO antenna system of FIG. 3.

FIG. 6(*b*) shows the 3D gain patterns of antenna 32 in the MIMO antenna system of FIG. 3.

FIGS. 7(*c*) and 7(*d*) illustrate the normalized simulated radiation patterns of the two antenna elements in the elevation plane, obtained at θ=90° elevation cuts, and show that the field for element one is maximum at Φ=40° and for element 2 is maximum at Φ=320°.

FIG. 12(*b*) shows the simulated gain and efficiency curves for antenna Ant-2 in the two-element antenna system of FIG. 10.

FIG. 13(*b*) shows the 3D gain patterns for antenna Ant-1 of the MIMO antenna system of the second embodiment, computed using HFSS at 3.6 GHz.

FIGS. 14(*c*) and 14(*d*) illustrate the normalized simulated radiation patterns of antenna elements one and two in the elevation plane, obtained at Φ-max=112° elevation cut for element one and Φ-max=68° elevation cut for element two.

DETAILED DESCRIPTION OF THE PREFERRED EMBODIMENTS

Figure 1:
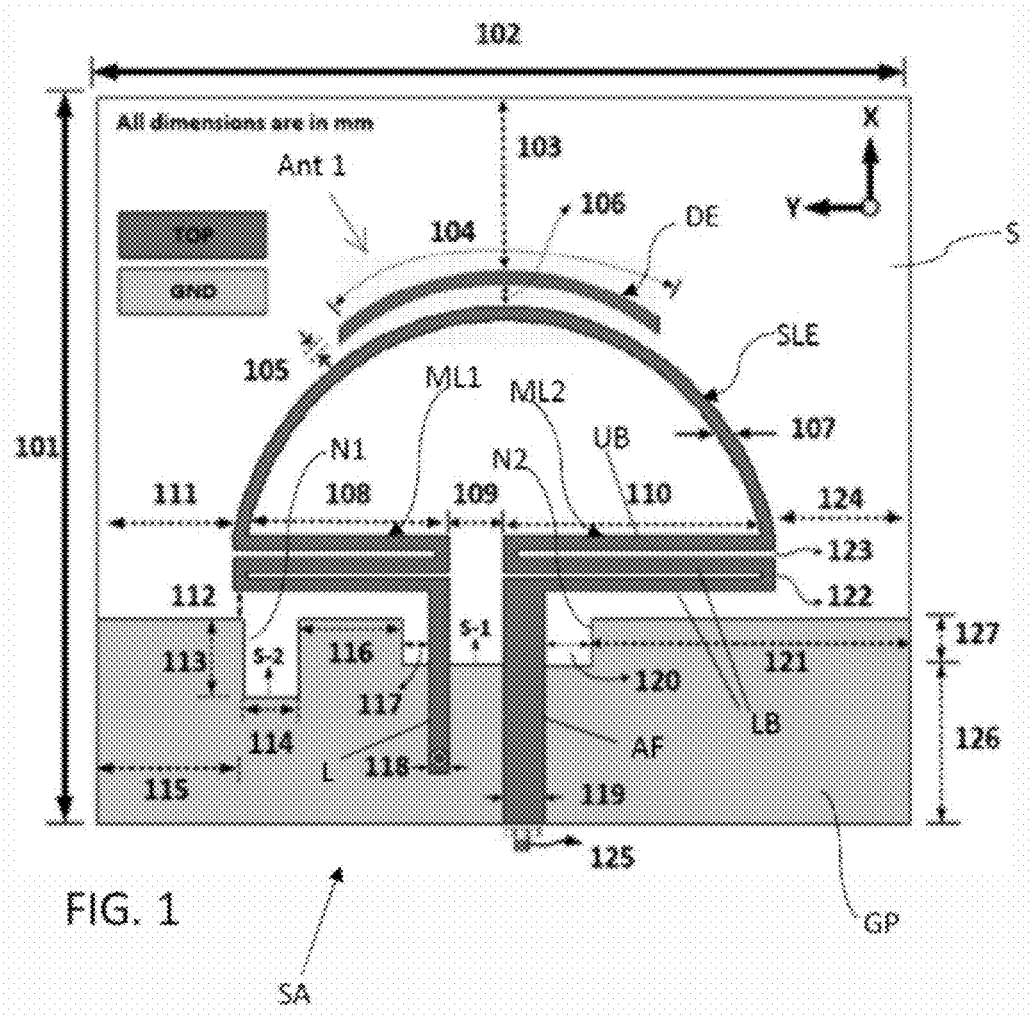
FIG. 1 shows the geometry of the single semi-loop meandered Yagi antenna design geometry according to the first embodiment of the invention.

In the first embodiment, a single semi-loop meandered Yagi antenna design geometry according to the invention is indicated generally at SA in FIG. 1. The antenna is designed and fabricated on a two-layer printed circuit board. It comprises a commercially available plastic FR-4 substrate S, with dielectric constant of 4, thickness of 0.76 mm and loss tangent of 0.02. The two-layer board can comprise any suitable commercial substrate material, but in the embodiments disclosed herein the described materials are preferred.

The total width dimension 101 of the substrate S of a single antenna element is 50 mm and the total length dimension 102 is 60 mm.

Referring to FIG. 1, a single antenna SA according to the first embodiment is applied to an FR-4 substrate S and comprises: a semi-loop or half-circular driven element SLE centered between opposite side edges of the substrate and that terminates at its opposite ends in meandered legs ML1 and ML2. Each of the meandered legs comprises a plurality of spaced apart parallel strips or bands connected together at alternate opposite ends to form a generally zig-zag pattern. In the example shown, there are two lower bands LB and an upper band UB. One end of the bottom strip or band in meandered leg ML2 is connected with an antenna feed line AF that extends across a truncated ground plane GP, which acts as a reflector element, to an SMA connector 125 to connect the antenna with an antenna input. The ground plane extends the full length 102 of the substrate and has one long edge coterminous with a length edge of the substrate and its other long edge spaced a short distance 112 below the meandered legs.

First and second notches N1 and N2 are formed in the upper edge of the ground plane, with notch N1 positioned below an outer end of meandered leg ML1 and notch N2 positioned under the center portion of the meandered legs. A line L is connected to meandered leg ML1 and extends across notch N1 into the ground plane but not all the way across the ground plane. Antenna feed AF extends from the other meandered leg ML2 into and across notch N2 and across the ground plane to connector 125. An arcuate director strip DE is spaced a short distance 106 from the apex of the element SLE.

In a specific example of the invention for the targeted bands, the substrate S has a width 101 of 50 mm and a length 102 of 60 mm. The half-circular driven element SLE has a width 107 tuned to 1 mm, a length of approximately 122.5 mm, and a diameter 108+109+110 that is half the guided wavelength ($\lambda g/2$), or 39 mm at the center frequency of 2 GHz. The truncated ground plane GP has a length 102 of 60 mm and a width 126+127 of 19.1 mm.

The arcuate strip forming the director element DE has a width 105 of 1 mm and a length 104 of 25 mm. The distance 103 of the director element DE from the adjacent edge 102 of the substrate S is 6.2 mm, and the spacing 106 between the director element DE and the driven semi-circular single loop element SLE is tuned to 1.62 mm.

The meandered legs ML1 and ML2 are spaced apart a distance 109 of 4 mm, the distance 108 from one end of the single loop element SLE to the inner end or edge of meandered leg ML1 is 15 mm, and the distance 110 from the other end of the single loop element to the inner end or edge of the meandered leg ML2 is 20 mm. The distances 111 and 124 between opposite ends of single loop element SLE and the side edges of the substrate S are equal at 10 mm, and the spacing 112 between the ground plane GP and the meandered legs ML1 and ML2 is 1.9 mm.

The depth 113 of notch N1 is 6.8 mm and the width 114 is 5.9 mm. The spacing 115 between the edge of notch N1 and the adjacent edge of the substrate and ground plane, which are coterminous, is 11.1 mm. Notches N1 and N2 are spaced apart a distance 116 of 5.5 mm, and meandered leg ML1 is spaced from the adjacent edge of notch N1 a distance 117 of 1.5 mm. Leg ML1 has a width 118 of 1.5 mm, and antenna feed AF has a width 119 of 1.478 mm and is spaced from the adjacent edge of notch N2 a distance 120 of 8.7 mm. Notch N2 is spaced from the adjacent edge of the substrate S a distance 121 of 19.8 mm. The bottom of notch N2 is spaced upwardly a distance 126 of 15 mm from the lower edge of the ground plane GP, and a distance 127 of 4.1 mm from the top edge of the ground plane.

The two lower branches LB of each of the meandered legs ML1 and ML2 have a combined width 122 of 2.5 mm, including the space between them, and those branches are spaced from the upper branch UB a distance 123 of 0.5 mm.

Figure 2:
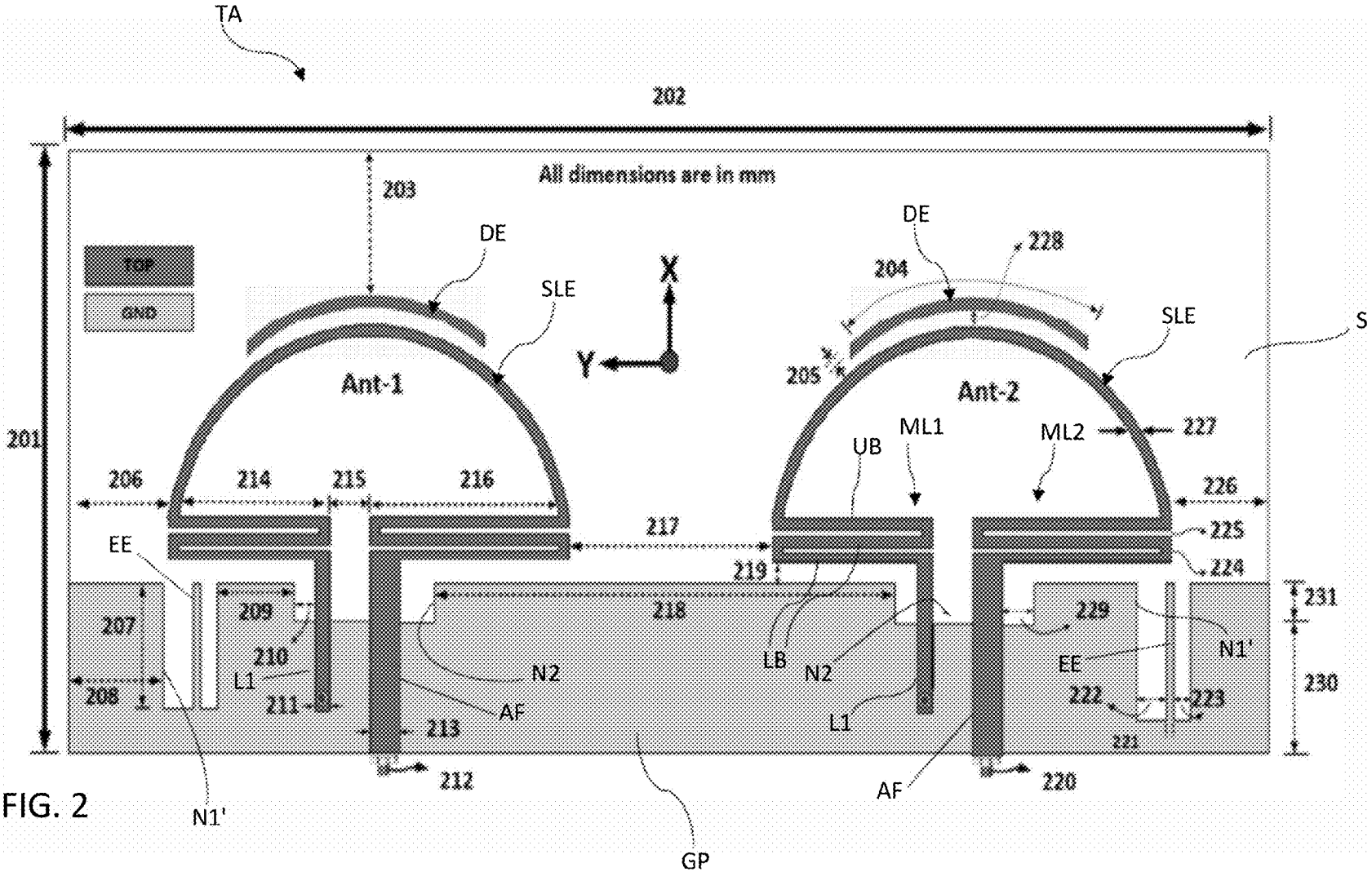
FIG. 2 shows the geometry of a two-element MIMO antenna system based on the antenna of FIG. 1.

FIG. 2 shows the geometry of a two-element MIMO antenna system TA utilizing two of the antennas SA of FIG. 1. The two-element MIMO antenna system TA has two antennas Ant 1 and Ant 2 arranged side-by-side on a substrate S having an overall width 201 of 50 mm and an overall length 202 of 120 mm. Semi-circular loop elements SLE each have a width 227 of 1 mm. The ground plane has the same length 202 of 120 mm as the overall length of the antenna system, and a width 230+231 of 19.1 mm. The width and length of each of the director elements DE, width 213 of the transmission lines TL, diameter 214+215+216 of the semi-ring loop elements SLE, and spacing 225 between the branches of the meandered legs and the width 224 of the meandered legs are all the same as that of the single antenna element shown in FIG. 1 and described above, i.e. 224 is 2.5 mm, 225 is 0.5 mm, 229 is 8.7 mm, 230 is 15 mm, and 231 is 4.1 mm. The spacing 217 between the two antenna elements Ant 1 and Ant 2 is 20 mm, and the spacing 228 between the directors DE and the respective semi-circular driven elements SLE is 1.62 mm. The spacing 203 between director elements DE and the adjacent edge of the substrate S is 6.2 mm. The depth 207 of notch N1 14.1 mm, and the spacing 208 between the notch and the adjacent edge of the substrate is 6.5 mm. Notch N2 is spaced a distance 209 of 8.5 mm from notch N1, and line L1 is spaced a distance 210 of 1.5 mm from the adjacent edge of the notch N1. Line L1 has a width 211 of 1.5 mm, and semi-circular loop elements SLE are spaced equal distances 206 and 226 of 10 mm from respective adjacent ends of the substrate S. Feed lines or antenna feeds AF each have a width 213 of 1.478 mm and are fed via SMA connectors, 212 and 220. Notches N2 are spaced apart a distance 218 of 39.6 mm, and the meandered legs are spaced from the ground plane GP a distance 219 of 1.9 mm.

The Notch N1 together with the extending element EE shown in FIG. 2 is etched out of the ground plane GP below the substrate S. The depth (length) of element EE is the same as the depth 207 of notch N1, which is 14.1 mm. The width 221 of element EE is 1 mm. The spacing 222 of extending element EE from the left edge of notch N1 is 4.5 mm, while its spacing 223 from the right edge of notch N1 is 2 mm.

The extending element EE together with notch N1 is used for back-lobe reduction, which eventually provides high front-to-back ratio (FBR), which is necessary for good Yagi-Uda performance. The principle behind back-lobe suppression is that the proposed notch N1 and the extending element EE significantly increases the magnitude of the current density towards the end-fire direction (along X-axis of FIG. 2) and hence a highly directional radiation pattern is obtained.

Figure 3:
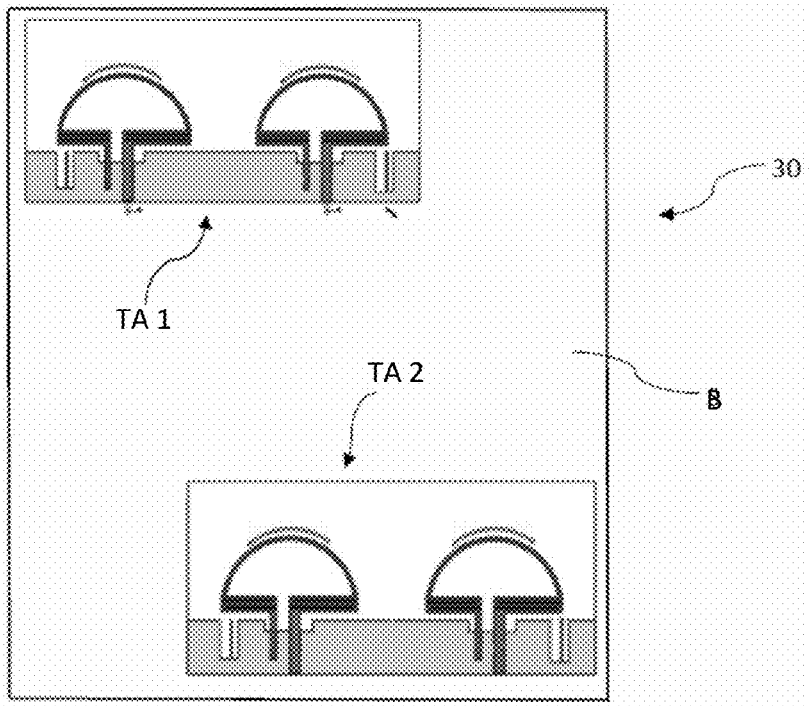
FIG. 3 shows two of the MIMO antenna systems of FIG. 2 placed inside a tablet or wireless handheld mobile terminal.

FIG. 3 shows two MIMO antenna systems TA 1 and TA 2, based on the antenna TA of FIG. 2, placed on a backing B inside a tablet or wireless handheld mobile terminal 30.

Figure 4:
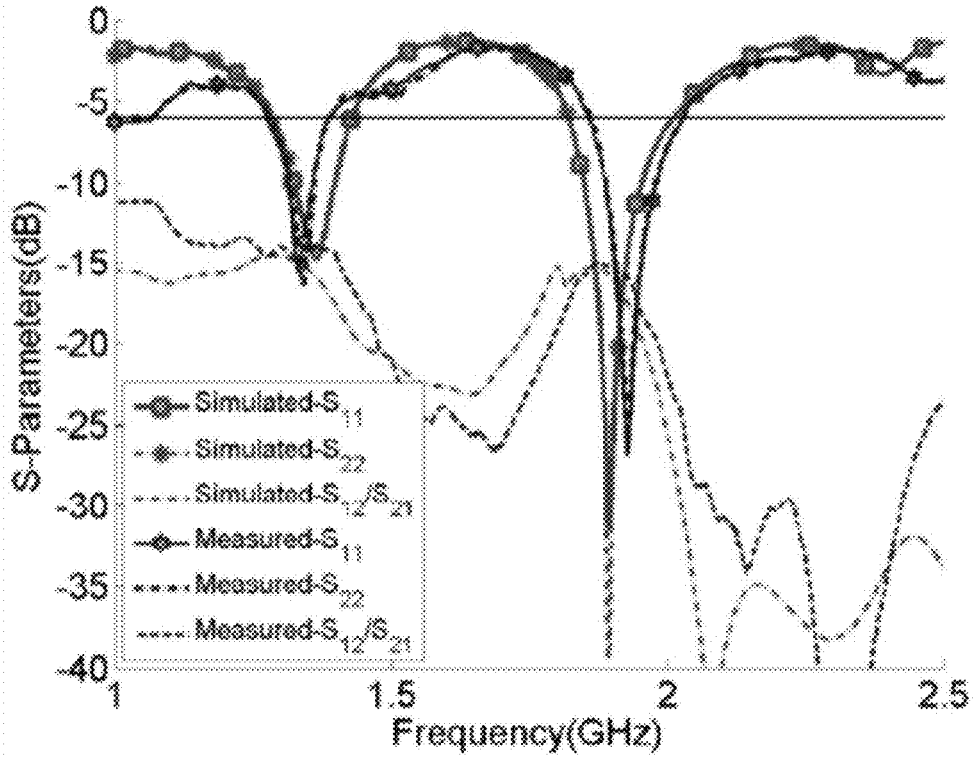
FIG. 4 shows the simulated and measured S-parameters obtained from a computer aided design tool (Computer Simulation Technology).

FIG. 4 shows the simulated and measured S-parameters obtained from a computer aided design tool (Computer Simulation Technology—CST). It can be seen that the MIMO antenna system has a minimum measured −6 dB bandwidth of 160 MHz, from 1.27-1.43 GHz in the lower band and 333 MHz, from 1.8-2.133 GHz in the higher band, which are the two bands of interest. It can also be seen that this MIMO antenna system has a minimum measured return loss of 15 Db, which is very close to the minimum simulated return loss of 14 dB. The minimum measured isolation is 15 dB within both bands, even by considering small inter-element spacing of $0.133\lambda_0$, which ensures good port efficiency performance. A good agreement is found between the simulated and measured results.

Figure 5A:
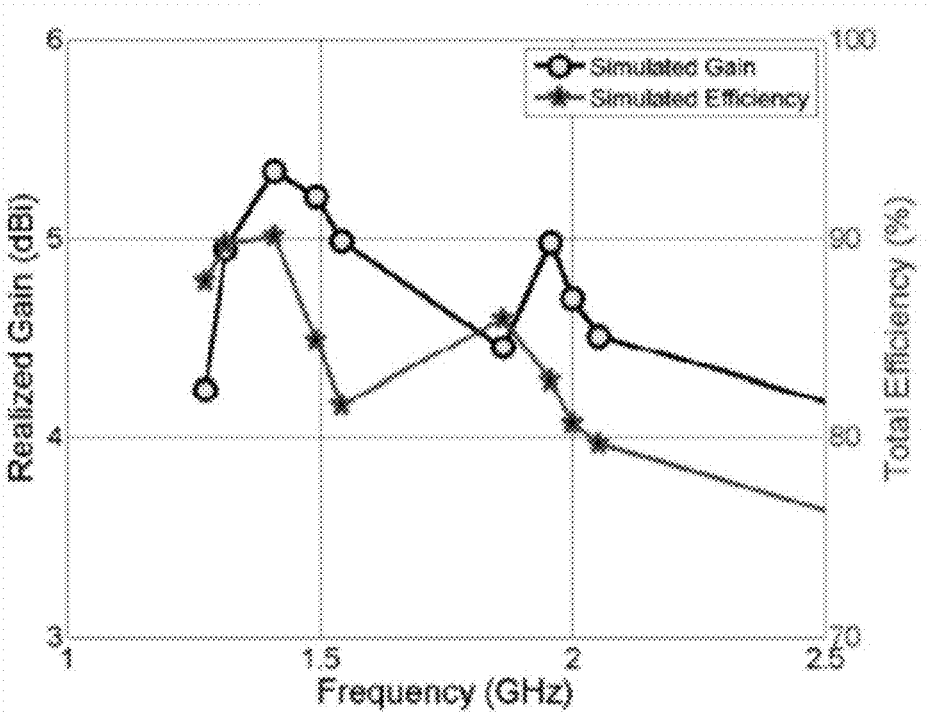
FIG. 5(*a*) shows the simulated gain and efficiency curves of antenna 31 in the 2-element MIMO antenna system of FIG. 3.
Figure 5B:
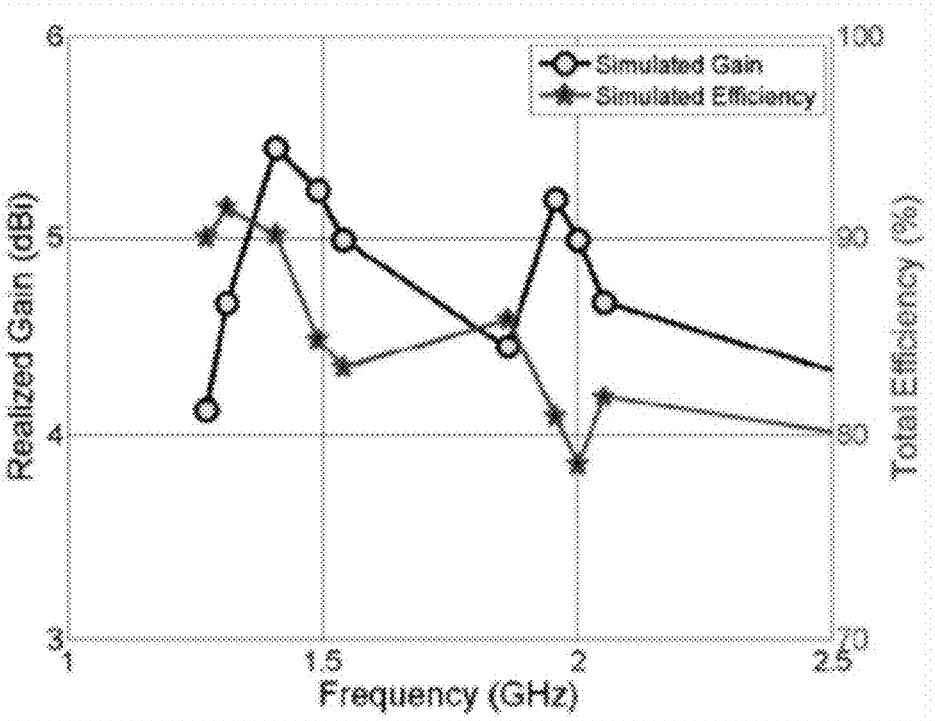

FIGS. 5(*a*) and 5(*b*) show the simulated gain and efficiency of the two-element MIMO antenna system. FIG. 5(*a*) shows the curves for antenna 31 (see FIG. 3), and FIG. 5(*b*) shows the simulated gain and efficiency for antenna 32. It can be seen that the minimum simulated realized gain is 5.44 dBi, while the minimum simulated total radiation efficiency is around 80% within both bands.

Figure 6A:
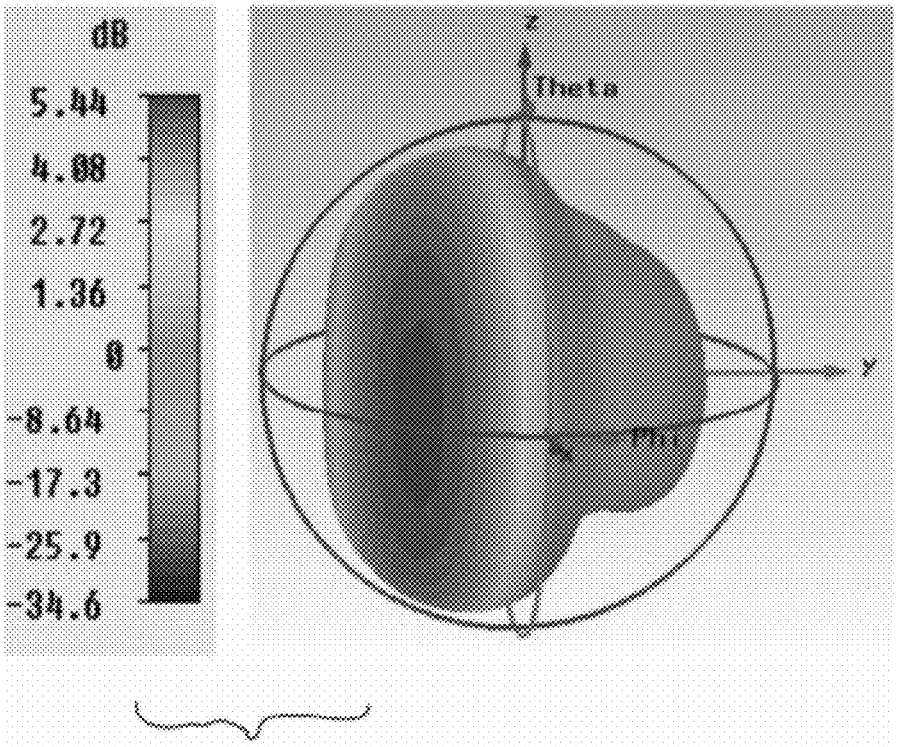
FIG. 6(*a*) shows the 3D gain patterns of antenna 31 in the MIMO antenna system of FIG. 3.
Figure 6B:
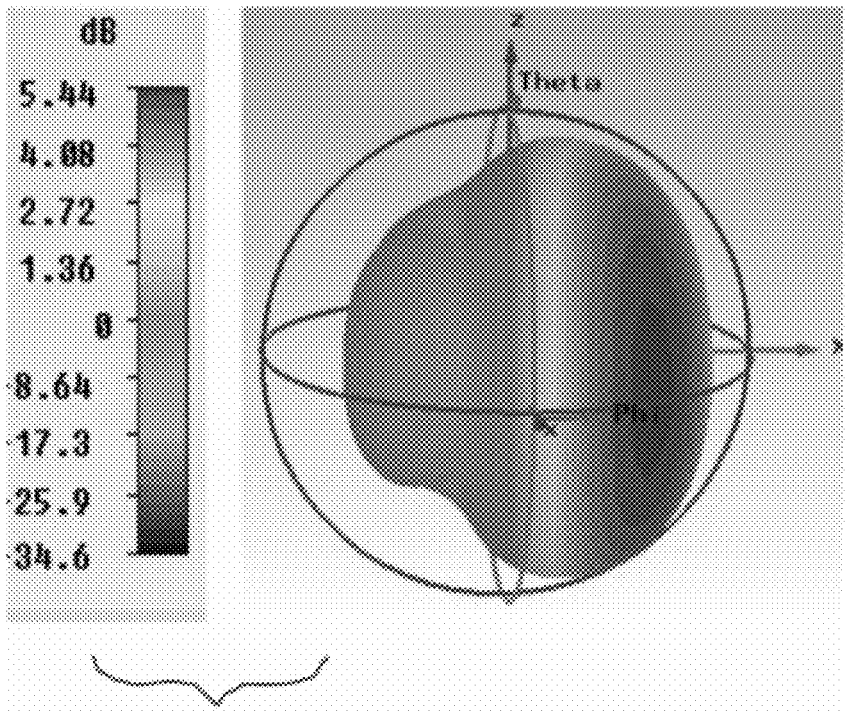
Figure 7A:
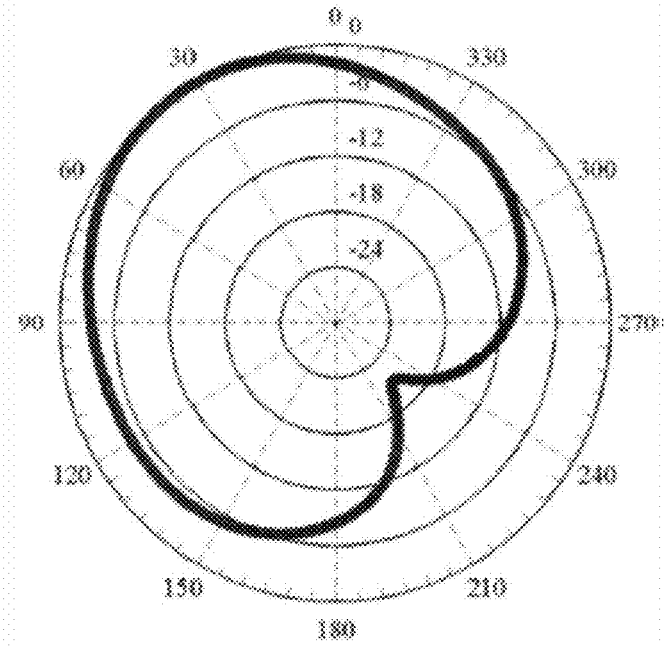
FIGS. 7(*a*) and 7(*b*) illustrate the normalized simulated radiation patterns of the two antenna elements in the azimuth plane, obtained at θ=90° azimuth cuts, and show that the field for element one is maximum at Φ=40° and for element 2 is maximum at Φ=320°.
Figure 7B:
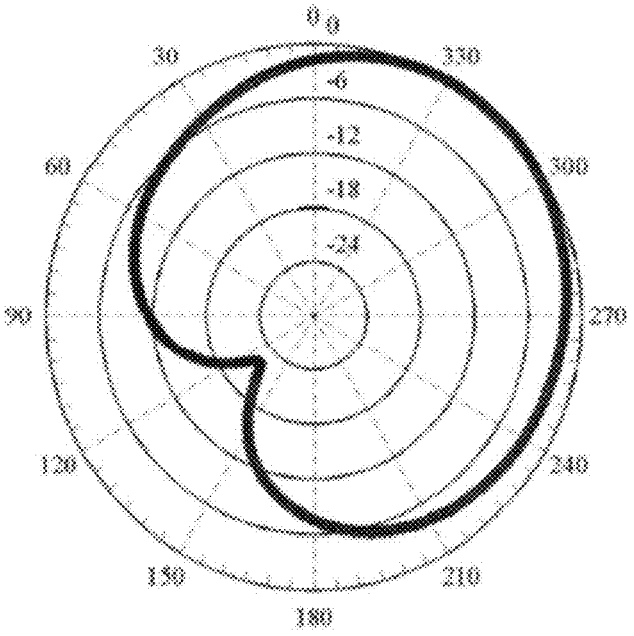
Figure 7C:
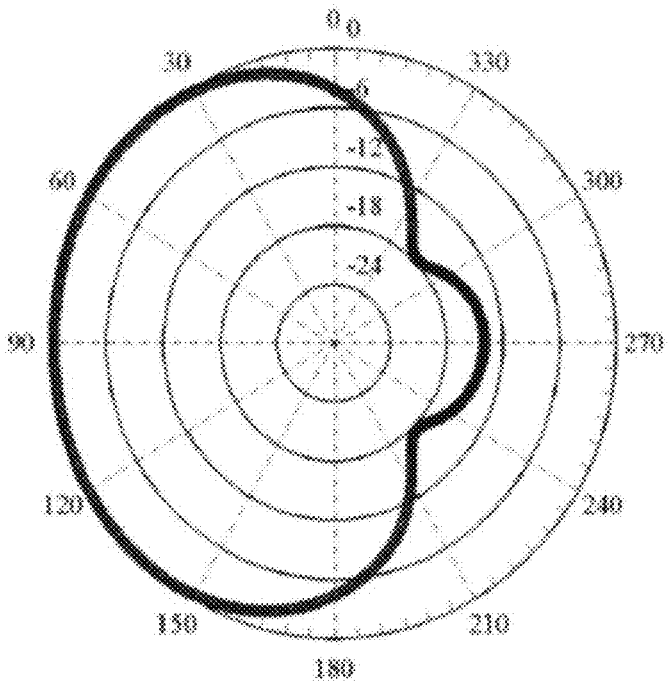
Figure 7D:
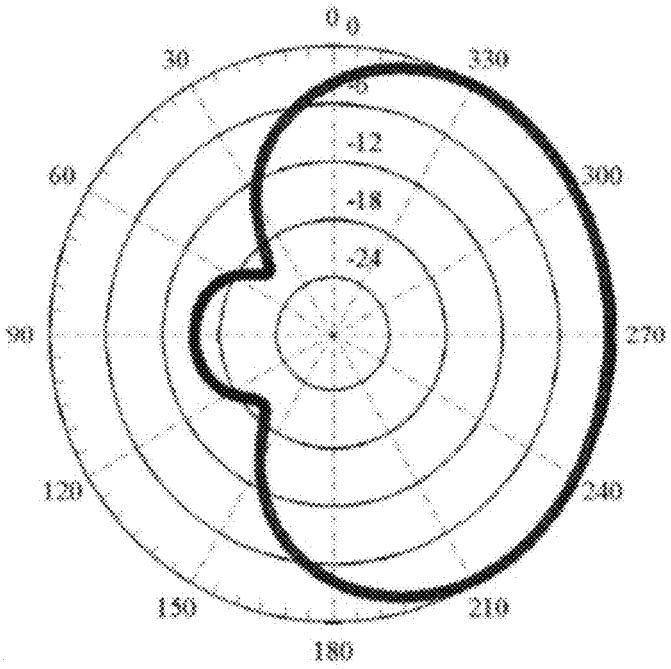

FIGS. 6(*a*) and 6(*b*) show the 3D gain patterns of the proposed MIMO antenna system computed using CST at 2 GHz. FIG. 6(*a*) shows the 3D gain pattern for antenna 31, while FIG. 6(*b*) shows the 3D gain pattern for antenna 32. It can be observed that the gain patterns are tilted, which ensures that the radiation patterns are highly uncorrelated in the far field, and hence this MIMO antenna system shows good MIMO performance in terms of field correlation.

FIGS. 7(*a*) through 7(*d*) show the normalized simulated radiation patterns of the two antenna elements in terms of $E_{Total}$ at 2 GHz in both azimuth and elevation planes. FIGS. 7(*a*) and 7(*b*) show these patterns for azimuth cuts obtained at $\theta=90°$ for elements 31 and 32, respectively. It can be observed that the field for element 31 is maximum at $\Phi=40°$, and for element 32 is maximum at $\Phi=320°$, and are apart from each other by 80°. FIGS. 7(*c*) and 7(*d*) show these patterns for elevation cuts obtained at $\Phi$-max=40° for element 31 and $\Phi$-max=320° for element 32. As evident from these FIGS., the radiation patterns are almost orthogonal in both planes and hence ensure very low correlation between the MIMO channels. The minimum simulated FBR in both azimuth and elevation planes is 20 Db, which ensures very good Yagi-Uda performance.

Figure 8:
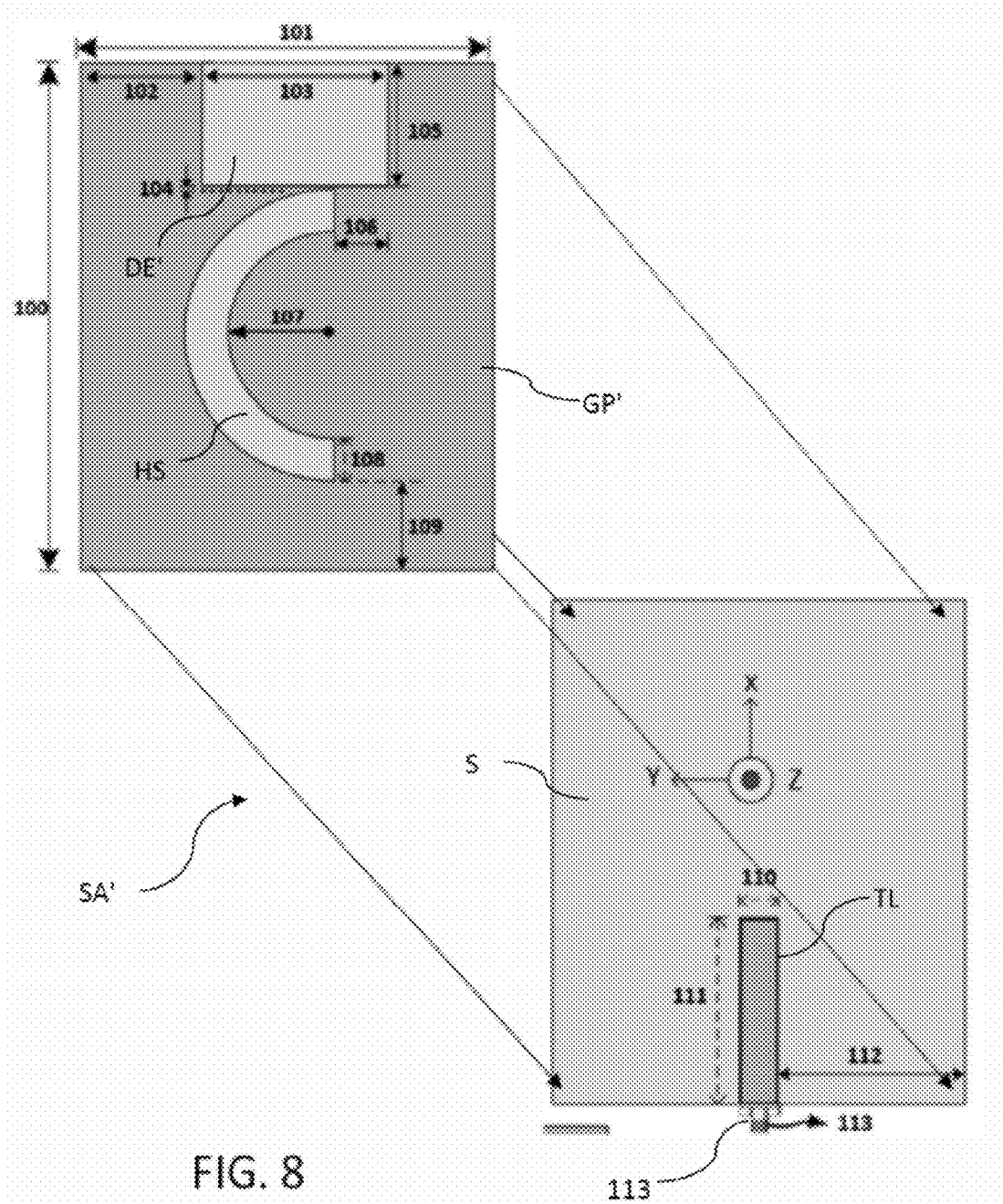
FIG. 8 shows the antenna design geometry of a single antenna element according to a second embodiment, wherein a half circle slot and rectangular director element are etched out of the bottom layer ground plane.
Figure 9:
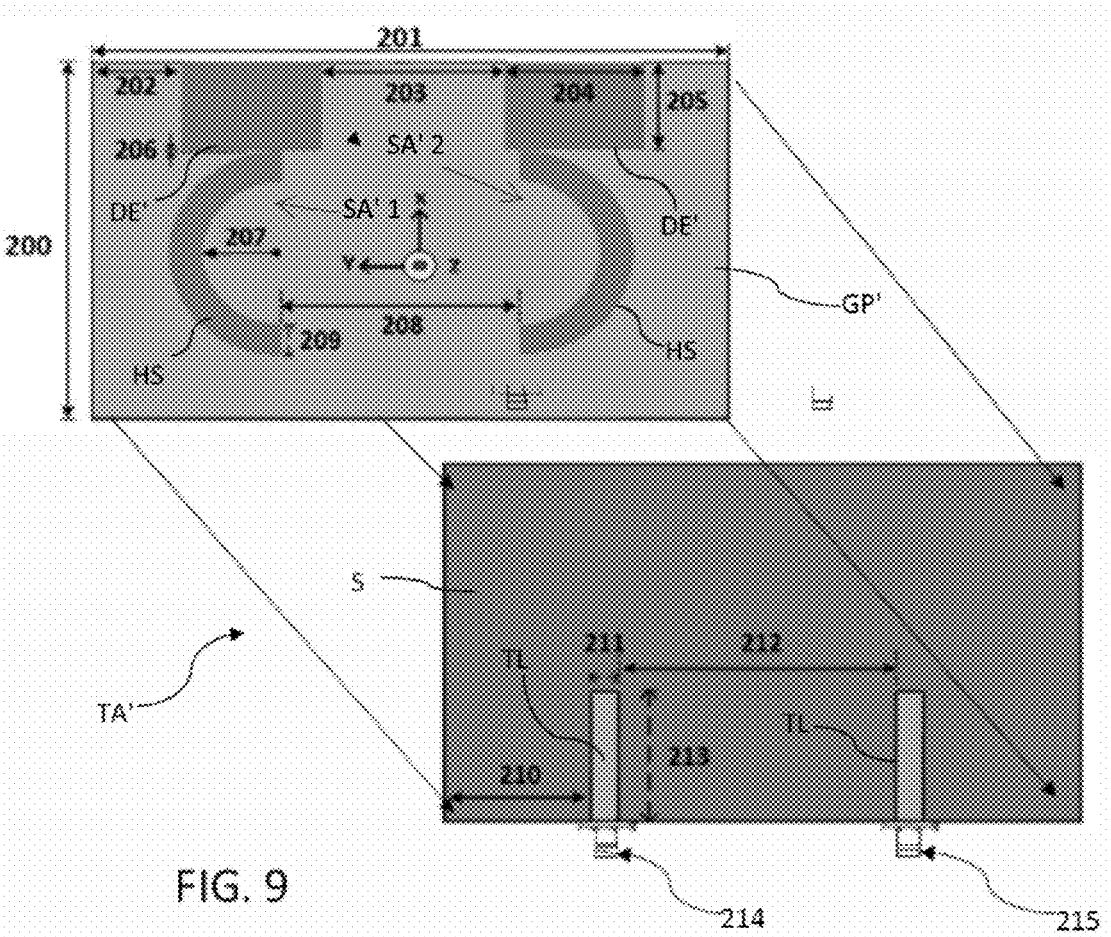
FIG. 9 shows the bottom and top layers of a two-element MIMO antenna system using the antenna design geometry of FIG. 8.
Figure 10:
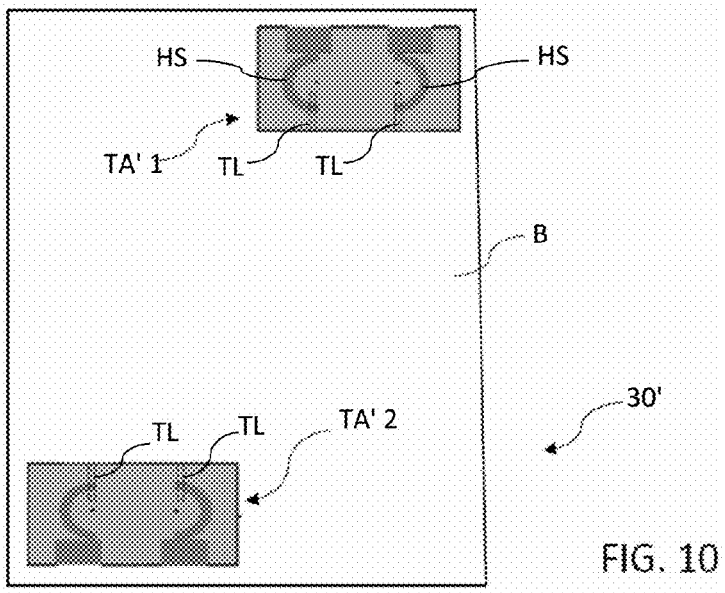
FIG. 10 shows two MIMO antenna systems of FIG. 9 placed inside a tablet or wireless handheld mobile terminal.

The second embodiment is shown in FIGS. 8-10. As seen in FIG. 8, a single Yagi-like antenna design geometry is indicated generally at SA'. The antenna SA' is designed and fabricated on a two-layer printed circuit board and is based on a half arc slot antenna HS with a complementary functional rectangular slot DE' that acts as a director to increase the front to back ratio of the antenna. The slots HS and DE' are etched out of a ground plane GP'. The rectangularly shaped director element DE' has a first side centered on a first edge of the ground plane, and the half circle driven element slot HS is arranged orthogonally to the director element with one end of the slot contiguous to a second side of the director element opposite the first side. The other end of slot HS is spaced from the edge of the ground plane opposite the first edge, and is fed by an antenna feed or transmission line TL on top of the underlying substrate S. The transmission line is fed via an SMA connector 113 (i.e. the antenna input), and is positioned relative to the slot HS so that it extends beneath the end of the slot that is remote from the director DE' (See, e.g., FIG. 10).

The antenna SA' is designed on a commercially available FR-4 plastic substrate S with dielectric constant of 4, thickness of 0.8 mm and loss tangent of 0.02). The total antenna size of the single antenna element has a length 100 of 40 mm and a width 101 of 40 mm. The half circle slot driven element HS has a typical radius 107 of 8 mm and a length half the guided wavelength ($\lambda g/2$), which is around 22.6 mm at the center frequency of 3.6 GHz. The width 108 of the slot is tuned to 3.3 mm to achieve the desired resonance. The transmission line TL has a width 110 with a typical value of 3 mm and length 111 with a typical value of 14.2 mm to get minimum reflection loss and match to 50Ω. The rectangularly shaped director element DE' has a width 103 of 14 mm and a length 105 of 9.5 mm. The dimensions 103, 105 of the director element are set to 14 mm×9.5 mm in this design, but can be changed based on the frequency band targeted. The spacing 104 between the director DE and the slot driven element HS is 0.2 mm, and the space 102 between the director element and the adjacent edge of the ground plane is 12 mm. One end of slot HS is inset a distance 106 of 4 mm from the adjacent edge of director element DE', and the other end of the slot is spaced a distance 109 of 7.7 mm from the adjacent edge of the ground plane. Transmission line TL is centered between the side edges of the substrate and is spaced a distance 112 of 18.5 mm from each of the side edges.

A two-element system is indicated generally at TA' in FIG. 9. This system incorporates two MIMO antenna elements SA' 1 and SA' 2, each element SA' 1 and SA' 2 based on the antenna SA' shown in FIG. 8. The MIMO antenna system has a length 201 of 80 mm and a width 200 of 40 mm. The separation 203 between the two rectangular directors is 28 mm, and the separation 208 between the two half circle slots (or driven elements as in Yagi based antennas) is 36 mm. The transmission lines TL on the top layer of the substrate S are separated by a distance 212 of 37 mm, and are spaced from the adjacent side edges of the substrate by a distance 210 of 18.5 mm so that they underlie the ends of the slots HS as described above and as shown in FIG. 10. The rectangularly shaped elements DE' that act as directors are spaced from adjacent edges of the ground plane by a distance 202 of 12 mm, and are separated from one another by a distance 203 of 28 mm. The MIMO antenna system is fed via SMA connectors 214 and 215. The rest of the dimensions are the same as shown in FIG. 8, e.g. each of the slots HS has a radius 207 of 8 mm and a width 208 of 3.3 mm, and the director elements each have a width 204 of 14 mm and a length 205 of 9.5 mm.

FIG. 10 shows two MIMO antenna systems TA' 1 and TA' 2, each based on the antenna TA' in FIG. 9, placed on a backing B inside a tablet or wireless handheld mobile terminal 30'.

Figure 11:
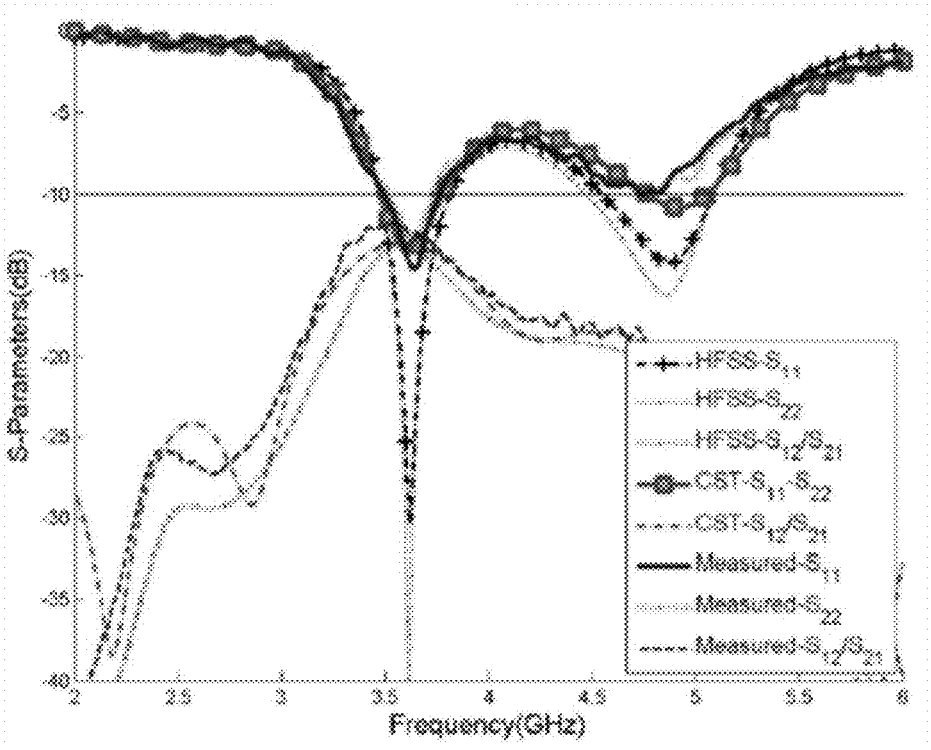
FIG. 11 shows the simulated and measured S-parameters for the antenna system of FIG. 10.

FIG. 11 shows the simulated and measured S-parameters obtained from two computer aided design tools (Computer Simulation Technology—CST, and High Frequency Structural Simulator—HFSS). It can be seen that the MIMO antenna system has a minimum measured bandwidth of 320 MHz covering from 3.48-3.8 GHz. It can also be seen that this MIMO antenna system has a minimum measured return loss of 15 Db, which is very close to the simulated (CST) return loss of 14.5 dB. The minimum measured isolation within the entire band is 12 Db, which ensures good port efficiency performance. A good agreement is found between the simulated and measured results.

Figure 12A:
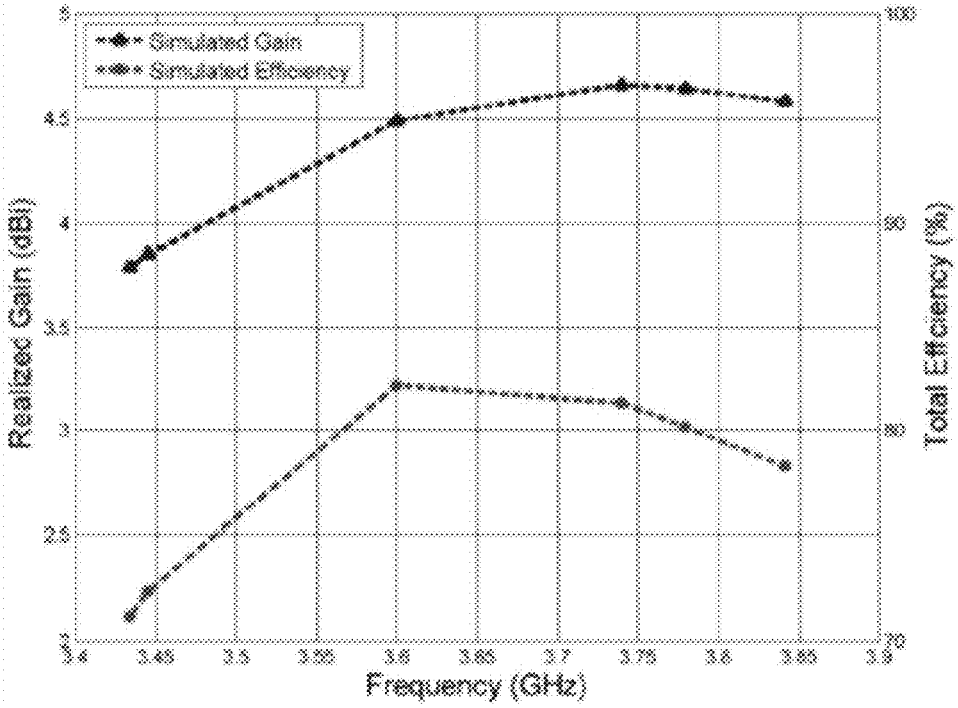
FIG. 12(*a*) shows the simulated gain and efficiency curves for antenna Ant-1 in the two-element antenna system of FIG. 10.
Figure 12B:
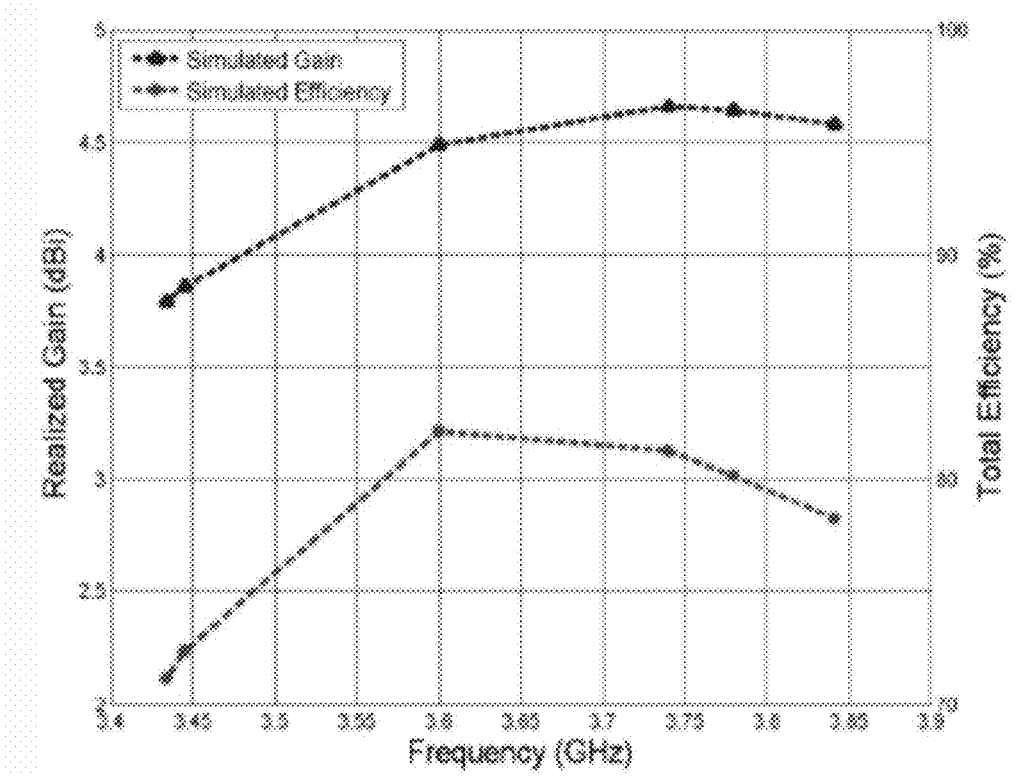

FIGS. 12(*a*) and 12*d*(*b*) show the simulated gain and efficiency of the two-element MIMO antenna system. FIG. 12(*a*) shows the curves for antenna Ant 1, and FIG. 12(*b*) shows the curves for antenna Ant 2. It can be seen that the minimum simulated realized gain is 4.1 dBi, while the minimum simulated total radiation efficiency is 75% across the entire band of operation.

Figure 13A:
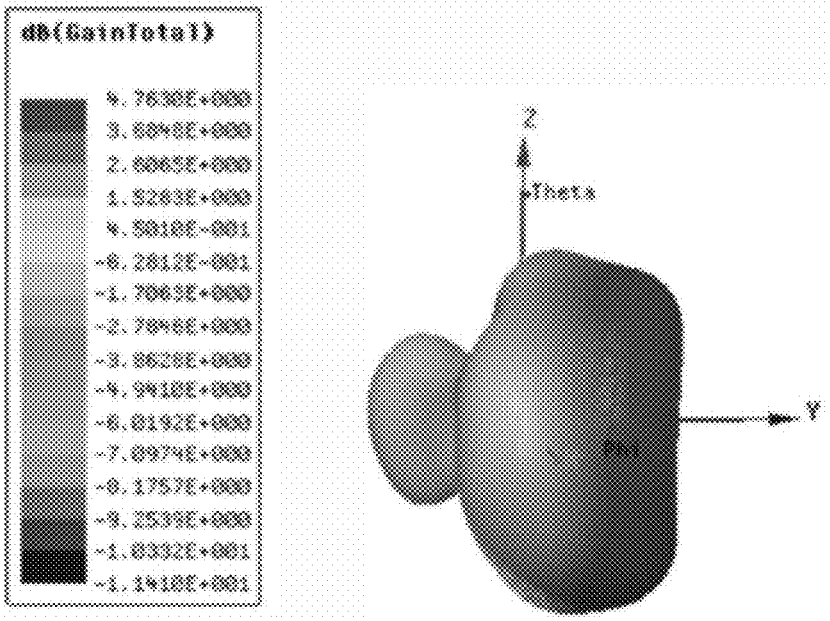
FIG. 13(*a*) shows the 3D gain patterns for antenna Ant-1 of the MIMO antenna system of the second embodiment, computed using HFSS at 3.6 GHz.
Figure 13B:
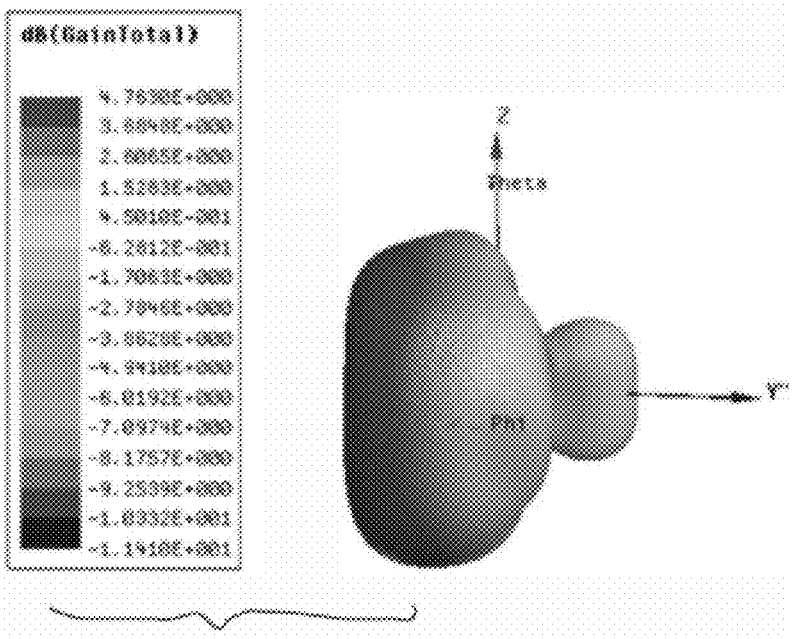
Figure 14A:
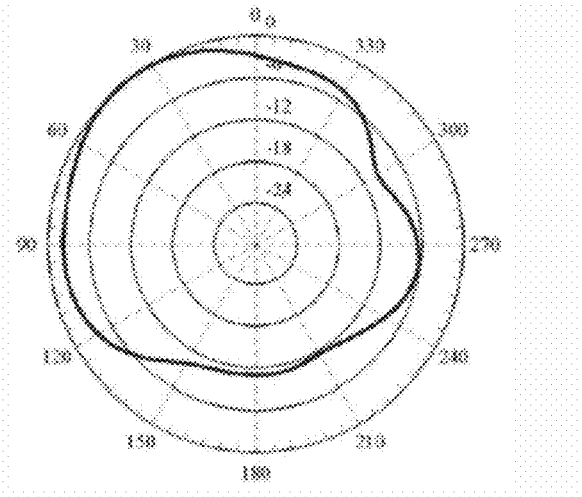
FIGS. 14(*a*) and 14(*b*) illustrate the normalized simulated radiation patterns of antenna elements one and two in the azimuth plane, obtained at θ=90° azimuth cut, showing that the field is maximum at Φ-max=40° for element one, and maximum at Φ-max=320° for element two.
Figure 14B:
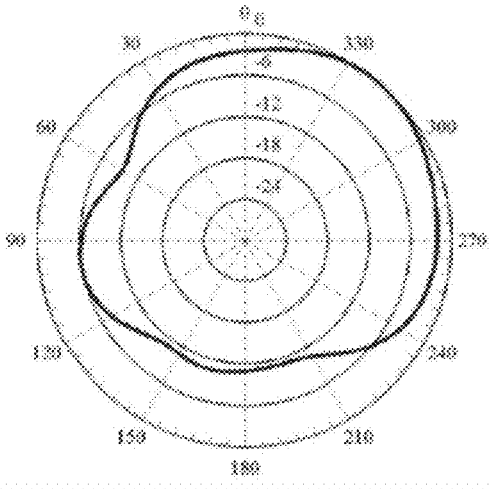
Figure 14C:
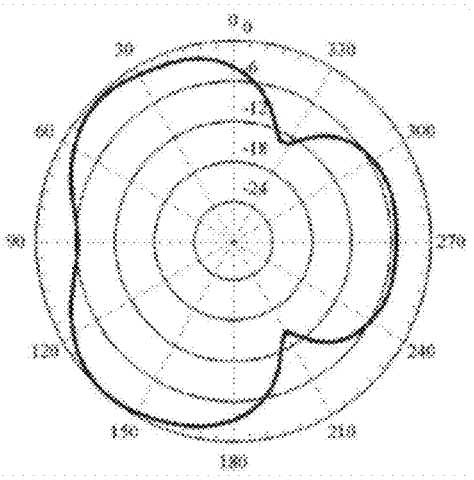
Figure 14D:
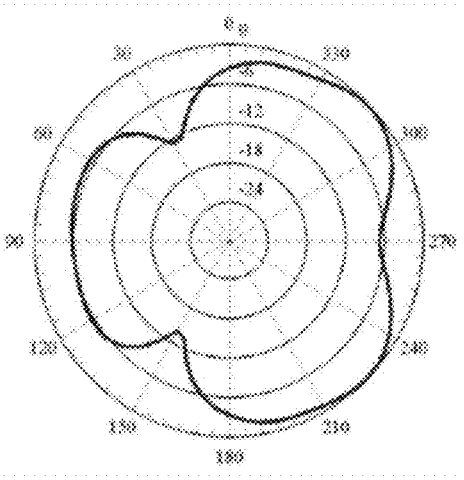

3D gain patterns of the proposed MIMO antenna system computed using HFSS at 3.6 GHz are shown in FIGS. 13(*a*) and 13(*b*). FIG. 13(*a*) shows the 3D pattern for antenna Ant 1, and FIG. 13(*b*) shows 3D pattern for antenna Ant 2. It can be observed that the gain patterns are tilted, which ensures that the radiation patterns are highly uncorrelated in the far field and hence this MIMO antenna system shows good MIMO performance in terms of field correlation.

FIGS. 14(*a*) through 14(*d*) show the normalized simulated radiation patterns for two elements Ant 1 and Ant 2 when they are placed inside a tablet or wireless handheld mobile terminal device 30' as depicted in FIG. 10. It can be observed that for elevation cuts the fields for elements Ant 1 and Ant 2 are maximum at Φ=40° and Φ=320°, respectively, and are apart from each other by 80°. FIGS. 14(*c*) and 14(*d*) show these patterns obtained at Φ-max=112° and Φ-max=68° for elements Ant 1 and Ant 2, respectively, for azimuth cuts. It can be seen that fields for elements Ant 1 and Ant 2 are maximum at θ=140° and θ=220°, respectively, and are also apart from each other by 80°. As evident from these FIGS., the radiation patterns are almost orthogonal in both planes and hence ensure very low correlation between the MIMO channels. The minimum simulated FBR in both azimuth and elevation plane is 11 dB and 9 Db, respectively.

As can be seen, multiple wide-bands are covered by the antenna systems of the invention. The covered bands can be changed according to the design requirements by changing the slot width, inter-slot spacing, etc. The very wide bandwidths obtained are essential for future wireless standards to support higher data rates as well as backward compatibility with current standards.

While the invention has been described in connection with its preferred embodiments, it should be recognized that changes and modifications may be made therein without departing from the scope of the appended claims.

What is claimed is:

1. A compact size, low profile antenna with high gain, wide dual-band coverage, highly directional radiation pattern, high front to back ratio and good efficiency for user terminal devices and small form factor electronics including mobile phones and other compact wireless devices, wherein said antenna is in MIMO configuration and mimics the features of a Yagi-Uda antenna, said antenna comprising:

a dielectric substrate;

an electrically conductive ground plane on the substrate, said ground plane acting as a reflector;

a driven element including an arcuate semi-loop;

a director element coplanar with and adjacent to the driven element to obtain high directivity and a highly directional radiation pattern; and a transmission line for conveying RF power to the antenna to excite the driven element; and wherein:

the arcuate semi-loop driven element has opposite ends and an apex;

a meandered leg is connected with a respective one of each of said opposite ends of said arcuate semi-loop; and said driven element comprises said arcuate semi-loop and said meandered legs.

2. The antenna as claimed in claim 1, wherein:

the director element comprises an arcuate ring sector spaced closely adjacent to and parallel to the arcuate semi-loop driven element at its apex, said arcuate ring sector having a length substantially less than the length of the arcuate semi-loop, and a width the same as the width of the arcuate semi-loop.

3. The antenna as claimed in claim 2, wherein:

said meandered legs each comprise a plurality of parallel spaced apart strips connected together at alternate ends to form a generally zig-zag pattern, one of said strips in each leg connected at one end to a respective adjacent end of said arcuate semi-loop, and another of said strips in one of said legs connected at one end to said transmission line; and said ground plane is truncated, wherein the ground plane has a length substantially the same as the length of the substrate and a width substantially less than the width of the substrate.

4. The antenna as claimed in claim 3, wherein:

the driven element, the director element, and at least a part of the transmission line are all printed on the substrate in coplanar relationship to one another.

5. The antenna as claimed in claim 4, wherein:

the transmission line extends across the ground plane to an adjacent length edge of the substrate to a connector for connection to a source of antenna input.

6. The antenna as claimed in claim 5, wherein:

said meandered legs are spaced apart from one another and are parallel to and spaced from an adjacent edge of said ground plane; and said arcuate semi-loop is on the side of said meandered legs opposite said ground plane.

7. The antenna as claimed in claim 6, wherein:

first and second notches are formed in a first edge of the ground plane adjacent the meandered legs, said first notch being positioned beneath an outer end of one of said meandered legs and said second notch being positioned beneath the inner ends of both said meandered legs, said transmission line extending through said second notch and across said ground plane to the edge of said ground plane opposite said first edge.

8. The antenna as claimed in claim 7, wherein:

said arcuate semi-loop, said arcuate ring sector director, and the strips forming the meandered legs each have a width of 1 mm.

9. The antenna as claimed in claim 8, wherein:

two of said antennas are on a substrate in spaced apart side-by-side relation to one another to form a dual-antenna system.

10. The antenna as claimed in claim 9, wherein:

a said dual-antenna system is mounted in each of two diagonally opposite corners of a rectangularly shaped backing in a tablet or other wireless handheld mobile terminal.

11. The antenna as claimed in claim 1, wherein:

the ground plane and substrate have substantially the same overall length and width dimensions;

the driven element comprises a half-arc slot etched out of the ground plane; and the director element comprises a rectangular slot etched out of the ground plane.

12. The antenna as claimed in claim 11, wherein:

the rectangularly shaped director element slot has a first side centered on a first edge of the ground plane;

the half-circle driven element slot is oriented orthogonally to the director element slot with one end of the driven element slot adjacent to a second side of the director element slot opposite the first side; and the other end of said driven element slot is spaced from the edge of the ground plane opposite the first edge and is fed by an antenna feed transmission line on top of the underlying substrate.

13. The antenna as claimed in claim 12, wherein:

the transmission line is positioned relative to the driven element slot so that it extends beneath an end of the driven element slot that is remote from the director element slot.

14. A miniaturized semi-loop dual antenna system with highly directional radiation pattern, high front to back ratio and good efficiency for user terminal devices and small form factor electronics including mobile phones and other compact wireless devices, wherein said antenna system is in MIMO configuration and mimics the features of a Yagi-Uda antenna, said antenna system comprising:

two dual antenna elements mounted in diagonally opposite corners of a rectangularly shaped backing, each said dual antenna element comprising:

a dielectric substrate;

an electrically conductive ground plane on the substrate, said ground plane acting as a reflector;

a driven element including an arcuate semi-loop;

a director element coplanar with and adjacent to the driven element to obtain high directivity and a highly directional radiation pattern; and a transmission line for conveying RF power to the antenna to excite the driven element.

15. The dual antenna system as claimed in claim 14 wherein:

the arcuate semi-loop driven element in each of said antenna elements has opposite ends and an apex;

a meandered leg is connected with a respective one of each of said opposite ends of each said arcuate semi-loop; and each said driven element comprises said arcuate semi-loop and said meandered legs.

16. The dual antenna system as claimed in claim 15, wherein:

the director element in each said antenna element comprises an arcuate ring sector spaced closely adjacent to and parallel to the respective arcuate semi-loop driven element at its apex, said arcuate ring sectors each having a length substantially less than the length of a respective arcuate semi-loop, and a width the same as the width of the arcuate semi-loops.

17. The dual antenna system as claimed in claim 14, wherein:

the arcuate semi-loop driven element and the director element are etched out of the ground plane.

18. The dual antenna system as claimed in claim 17, wherein:

said arcuate semi-loop driven element is oriented orthogonally to said rectangular director element so that one end of the arcuate semi-loop is adjacent to said director element and the opposite end of the arcuate semi-loop is remote from the director element.

* * * * *